US006499950B2

(12) United States Patent
Willett et al.

(10) Patent No.: US 6,499,950 B2
(45) Date of Patent: Dec. 31, 2002

(54) COOLING CIRCUIT FOR A GAS TURBINE BUCKET AND TIP SHROUD

(76) Inventors: Fred Thomas Willett, 25 Long Creek Dr., Burnt Hills, NY (US) 12027; Gary Michael Itzel, 12 Cider Mill Dr., Clifton Park, NY (US) 12065; Dimitrios Stathopoulos, 11 Wyngate Rd., Glenmont, NY (US) 12077; Larry Wayne Plemmons, deceased, late of Hamilton, OH (US); by Helen M. Plemmons, executor, 2900 Long Ridge Trails, Hamilton, OH (US) 45014; Doyle C. Lewis, 444 River Way, Greer, SC (US) 29651

( * ) Notice: Subject to any disclaimer, the term of this patent is extended or adjusted under 35 U.S.C. 154(b) by 0 days.

(21) Appl. No.: 09/852,673

(22) Filed: May 11, 2001

(65) Prior Publication Data

US 2001/0048878 A1 Dec. 6, 2001

Related U.S. Application Data

(63) Continuation of application No. 09/285,499, filed on Apr. 1, 1999, now abandoned.

(51) Int. Cl.[7] ..... F01D 5/18

(52) U.S. Cl. ..... 416/97 R; 416/90 R; 416/92; 416/189; 416/191; 416/192

(58) Field of Search ..... 415/115; 416/90 R, 416/92, 96 R, 96 A, 97 R, 189, 190, 191, 192

(56) References Cited

U.S. PATENT DOCUMENTS

| | | | | | |
|---|---|---|---|---|---|
| 1,651,503 | A | * | 12/1927 | Belluzzo | |
| 3,014,270 | A | * | 12/1961 | Eccles | 416/92 |
| 3,427,001 | A | * | 2/1969 | Malley et al. | 416/92 |

(List continued on next page.)

FOREIGN PATENT DOCUMENTS

| | | | | |
|---|---|---|---|---|
| FR | 2275975 A | * | 2/1976 | |
| GB | 960071 A | * | 6/1964 | 416/97 R |
| GB | 1426049 A | * | 2/1976 | |
| GB | 2067674 A | * | 7/1981 | |
| JP | 58-47104 A | * | 3/1983 | 416/189 |
| JP | 2-23201 A | * | 1/1990 | |
| JP | 2-221602 A | * | 9/1990 | 416/90 R |

OTHER PUBLICATIONS

"39th GE Turbine State–of–the–Art Technology Seminar", Tab 1, "'F'Technology –the First Half–Million Operating Hours", H. E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA –An Advanced–Technology 70–MW Class 50/60 Hz Gas Turbine", Ramachandran et al., Aug. 1996.

(List continued on next page.)

*Primary Examiner*—Christopher Verdier

(57) ABSTRACT

An open cooling circuit for a gas turbine bucket wherein the bucket has an airfoil portion, and a tip shroud, the cooling circuit including a plurality of radial cooling holes extending through the airfoil portion and communicating with an enlarged internal area within the tip shroud before exiting the tip shroud such that a cooling medium used to cool the airfoil portion is subsequently used to cool the tip shroud.

18 Claims, 4 Drawing Sheets

U.S. PATENT DOCUMENTS

| | | | | | |
|---|---|---|---|---|---|
| 3,527,544 | A | * | 9/1970 | Allen | |
| 3,533,711 | A | * | 10/1970 | Kercher | 416/90 R |
| 3,606,574 | A | * | 9/1971 | Brands et al. | 416/96 R |
| 3,628,885 | A | * | 12/1971 | Sidenstick et al. | 416/92 |
| 3,876,330 | A | * | 4/1975 | Pearson et al. | |
| 3,982,851 | A | * | 9/1976 | Andersen et al. | |
| 4,012,167 | A | * | 3/1977 | Noble | |
| 4,073,599 | A | * | 2/1978 | Allen et al. | |
| 4,127,358 | A | * | 11/1978 | Parkes | |
| 4,162,136 | A | * | 7/1979 | Parkes | |
| 4,606,701 | A | * | 8/1986 | McClay | |
| 4,940,388 | A | * | 7/1990 | Lilliker et al. | |
| 4,948,338 | A | * | 8/1990 | Wickerson | |
| 5,350,277 | A | * | 9/1994 | Jacala et al. | |
| 5,391,052 | A | * | 2/1995 | Correia et al. | |
| 5,460,486 | A | * | 10/1995 | Evans et al. | |
| 5,480,281 | A | * | 1/1996 | Correia | |
| 5,482,435 | A | * | 1/1996 | Dorris et al. | |
| 5,486,090 | A | * | 1/1996 | Thompson et al. | |
| 5,531,568 | A | * | 7/1996 | Broadhead | |
| 5,538,393 | A | * | 7/1996 | Thompson et al. | |
| 5,785,496 | A | * | 7/1998 | Tomita | |
| 6,099,253 | A | * | 8/2000 | Fukue et al. | 416/97 R |
| 6,340,284 | B1 | | 1/2002 | Beeck et al. | |

OTHER PUBLICATIONS

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "Tab 6, GE Aeroderivative Gas Turbines –Design and Operating Features", M. W. Horner, Aug. 1996.

"39th GE Turbine State–of–the–Art Technology Seminar", Tab 7, "Advance Gas Turbine Materials and Coatings", P. W. Schilke, Aug. 1996.

"39th GE Turbine State–of–the–Art Technology Seminar", Tab 8, "Dry Low $NO_x$ Combustion Systems for GE Heavy–Duty Turbines", L. B. Davis, Aug. 1996.

"39th GE Turbine State–of–the–Art Technology Seminar", Tab 9, "GE Turbine Combustion Flexibility", M. A. Davi, Aug. 1996.

"39th GE Turbine State–of–the–Art Technology Seminar", Tab 10, "Gas Fuel Clean–Up System Design Considerations for GE Heavy–Duty Gas Turbines", C. Wilkes, Aug. 1996.

"39th GE Turbine State–of–the–Art Technology Seminar", Tab 11, "Integrated Control Systems for Advanced Combined Cycles", Chu et al., Aug. 1996.

"39th GE Turbine State–of–the–Art Technology Seminar", Tab 12, "Power Systems for the 21st Century "H" Gas Turbine Combined Cycles", Paul et al., Aug. 1996.

"39th GE Turbine State–of–the–Art Technology Seminar", Tab 13, "Clean Coal and Heavy Oil Technologies for Gas Turbines", D. M. Todd, Aug. 1996.

"39th GE Turbine State–of–the–Art Technology Seminar", Tab 14, "Gas Turbine Conversions, Modifications and Uprates Technology", Stuck et al., Aug. 1996.

"39th GE Turbine State–of–the–Art Technology Seminar", Tab 15, "Performance and Reliability Improvements for Heavy–Duty Gas Turbines," J. R. Johnston, Aug. 1996.

"39th GE Turbine State–of–the–Art Technology Seminar", Tab 16, "Gas Turbine Repair Technology", Crimi et al., Aug. 1996.

"39th GE Turbine State–of–the–Art Technology Seminar", Tab 17, "Heavy Duty Turbine Operating & Maintenance Considerations", R. F. Hoeft, Aug. 1996.

"39th GE Turbine State–of–the–Art Technology Seminar", Tab 18, "Gas Turbine Performance Monitoring and Testing", Schmitt et al., Aug. 1996.

"39th GE Turbine State–of–the–Art Technology Seminar", Tab 19, "Monitoring Service Delivery System and Diagnostics", Madej et al., Aug. 1996.

"39th GE Turbine State–of–the–Art Technology Seminar", Tab 20, "Steam Turbines for Large Power Applications", Reinker et al., Aug. 1996.

"39th GE Turbine State–of–the–Art Technology Seminar", Tab 21, "Steam Turbines for Ultrasupercritical Power Plants", Retzlaff et al., Aug. 1996.

"39th GE Turbine State–of–the–Art Technology Seminar", Tab 22, "Steam Turbine Sustained Efficiency", P. Schofield, Aug. 1996.

"39th GE Turbine State–of–the–Art Technology Seminar", Tab 23, "Recent Advances in Steam Turbines for Industrial and Cogeneration Applications", Leger et al., Aug. 1996.

"39th GE Turbine State–of–the–Art Technology Seminar", Tab 24, "Mechanical Drive Steam Turbines", D. R. Leger, Aug. 1996.

"39th GE Turbine State–of–the–Art Technology Seminar", Tab 25, "Steam Turbines for STAG™ Combined–Cycle Power Systems", M. Boss, Aug. 1996.

"39th GE Turbine State–of–the–Art Technology Seminar", Tab 26, "Cogeneration Application Considerations", Fisk et al., Aug. 1996.

"39th GE Turbine State–of–the–Art Technology Seminar", Tab 27, "Performance and Economic Considersations of Repowering Steam Power Plants", Stoll et al., Aug. 1996.

"39th GE Turbine State–of–the–Art Technology Seminar", Tab 28, "High–Power–Density™ Steam Turbine Design Evolution", J. H. Moore, Aug. 1996.

"39th GE Turbine State–of–the–Art Technology Seminar", Tab 29, "Advances in Steam Path Technologies", Cofer, IV, et al., Aug. 1996.

"39th GE Turbine State–of–the–Art Technology Seminar", Tab 30, "Upgradable Opportunities for Steam Turbines", D. R. Dreier, Jr., Aug. 1996.

"39th GE Turbine State–of–the–Art Technology Seminar", Tab 31, "Uprate Options for Industrial Turbines", R. C. Beck, Aug. 1996.

"39th GE Turbine State–of–the–Art Technology Seminar", Tab 32, "Thermal Performance Evaluation and Assessment of Steam Turbine Units", P. Albert, Aug. 1996.

"39th GE Turbine State–of–the–Art Technology Seminar", Tab 33, "Advances in Welding Repair Technology", J. F. Nolan, Aug. 1996.

"39th GE Turbine State–of–the–Art Technology Seminar", Tab 34, "Operation and Maintenance Strategies to Enhance Plant Profitability"MacGillivray et al., Aug. 1996.

"39th GE Turbine State–of–the–Art Technology Seminar", Tab 35, "Generator Insitu Inspections", D. Stanton.

"39th GE Turbine State–of–the–Art Technology Seminar", Tab 36, "Generator Upgrade and Rewind", Halpern et al., Aug. 1996.

"39th GE Turbine State–of–the–Art Technology Seminar", Tab 37, "GE Combined Cycle Product Line and Performance", Chase et al., Aug. 1996.

"39th GE Turbine State–of–the–Art Technology Seminar", Tab 38, "GE Combined Cycle Experience", Maslak et al., Aug. 1996.

"39th GE Turbine State–of–the–Art Technology Seminar", Tab 39, "Single–Shaft Combined Cycle Power Generation Systems", Tomlinson et al., Aug. 1996.
"Advanced Turbine System Program–Conceptual Design and Product Development", Annual Report, Sep. 1, 1994 –Aug. 31, 1995.
"Advanced Turbine Systems (ATS Program) Conceptual Design and Product Development", Final Technical Progress Report, Vol. 2–Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Enviromental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliablility of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier", paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development", Advanced Turbine Systems Annual Review Meeting, Nov. 7–8, 1996, Washington, D.C., Publication Release.
"H Technology Commercialization", 1998 MarComm Activity Recommendation, Mar. 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products", Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H"Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century –"H"Gas Turbine Combined Cycles", Thomas C. Paul et al., Report,.
"Power—Gen '96 Europe", Conference Programme, Budapest, Hungary, Jun. 26–28, 1996.
"Power—Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, pp. 3–13, Oct. 1995.
"Proceedings of the Advanced Turbine Systems Annual Program Review Meeting", vol. I, "H Gas Turbine Combined Cycle", J. Corman, pp. 14–21, Oct. 1995.
"Proceedings of the Advanced Turbine Systems Annual Program Review Meeting", vol. I, "Overview of Westinghouse's Advanced Turbine Systems Program", Bannister et al., pp. 22–30, Oct. 1995.
"Proceedings of the Advanced Turbine Systems Annual Program Review Meeting", vol. I, "Allison Engine ATS Program Technical Review"D. Mukavetz., pp. 31–42, Oct. 1995.
"Proceedings of the Advanced Turbine Systems Annual Program Review Meeting", vol. I, "Advanced Turbine Systems Program Industrial System Concept Development", S. Gates, pp. 43–63, Oct. 1995.
"Proceedings of the Advanced Turbine Systems Annual Program Review Meeting", vol. I, "Advanced Turbine System Program Phase 2 Cycle Selection", Latcovich, Jr., pp. 64–69, Oct. 1995.
"Proceedings of the Advanced Turbine Systems Annual Program Review Meeting", vol. I, "General Electric ATS Program Technical Review Phase 2 Activities", Chance et al., pp. 70–74, Oct. 1995.
"Proceedings of the Advanced Turbine Systems Annual Program Review Meeting", vol. I, "Technical Review of Westinghouse's Advanced Turbine Systems Program", Diakunchak et al., pp. 75–86, Oct. 1995.
"Proceedings of the Advanced Turbine Systems Annual Program Review Meeting", vol. I, "Advanced Combustion Turbines and Cycles: An EPRI Perspective", Touchton et al., pp. 87–88, Oct. 1995.
"Proceedings of the Advanced Turbine Systems Annual Program Review Meeting", vol. I, "Advanced Turbine Systems Annual Program Review", William E. Koop, pp. 89–92, Oct. 1995.
"Proceedings of the Advanced Turbine Systems Annual Program Review Meeting", vol. I, "The AGTSR Consortium: An Update", Fant et al., pp. 93–102. Oct. 1995.

"Proceedings of the Advanced Turbine Systems Annual Program Review Meeting",vol. I, "Overview of Allison/AGTSR Interactions", Sy A. Ali, pp. 103–106, Oct. 1995.

"Proceedings of the Advanced Turbine Systems Annual Program Review Meeting", vol. I, "Design Factors for Stable Lean Premix Combustion", Richards et al., pp. 107–113, Oct. 1995.

"Proceedings of the Advanced Turbine Systems Annual Program Review Meeting", vol. I, "Ceramic Stationary as Turbine", M. van Roode, pp. 114–147, Oct. 1995.

"Proceedings of the Advanced Turbine Systems Annual Program Review Meeting", vol. I, "DOE/Allison Ceramic Vane Effort"Wenglarz et al., pp. 148–151, Oct. 1995.

"Proceedings of the Advanced Turbine Systems Annual Program Review Meeting", vol. I, "Materials/Manufacturing Element of the Advanced Turbine Systems Program", Karnitz et al., pp. 152–160, Oct. 1995.

"Proceedings of the Advanced Turbine Systems Annual Program Review Meeting", vol. I, "Land–Based Turbine Casting Initiative", Mueller et al., pp. 161–170, Oct. 1995.

"Proceedings of the Advanced Turbine Systems Annual Program Review Meeting", vol. I, "Turbine Airfoil Manufacturing Technology", Kortovich, pp. 171–181, Oct. 1995.

"Proceedings of the Advanced Turbine Systems Annual Program Review Meeting", vol. I, "Pratt & Whitney Thermal Barrier Coatings", Bornstein et al., pp. 182–193, Oct. 1995.

"Proceedings of the Advanced Turbine Systems Annual Program Review Meeting", vol. I, "Westinhouse Thermal Barrier Coatings", Goedjen et al., pp 194–199, Oct. 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and Heterogeneous Catalysis", Dibble et al., pp. 221–232, Oct. 1995.

"Proceedings of the Advanced Turbine Systems Annual Program Review Meeting", vol. II, "Rayleigh/Raman/LIF Measurements in a Turbulent Lean Premixed Combustor", Nandula et al., pp. 233–248, Oct. 1995.

"Proceedings of the Advanced Turbine Systems Annual Program Review Meeting", vol. II, "Lean Premixed Flames for Low $No_x$combustors", Sojka et al., pp. 249–275, Oct. 1995.

"Proceedings of the Advanced Turbine Systems Annual Program Review Meeting", vol. II, "Functionally Gradient Materials for Thermal Barrier Coating in Advanced Gas Turbine Systems", Banovic et al., pp. 276–280, Oct. 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct. 1995.

"Proceedings of the Advanced Turbine Systems Annual Program Review Meeting", vol. II, "Life Prediction of Advanced Materials for Gas Turbine Application", Zamrik et al., pp. 310–327, Oct. 1995.

"Proceedings of the Advanced Turbine Systems Annual Program Review Meeting", vol. II, "Advanced Combustion Technologies for Gas Turbine Power Plants", Vandsburger et al., pp. 328–352, Oct. 1995.

"Proceedings of the Advanced Turbine Systems Annual Program Review Meeting", vol. II, "Combustion Modeling in Advanced Gas Turbine Systems", Smoot et al., pp. 353–370, Oct. 1995.

"Proceedings of the Advanced Turbine Systems Annual Program Review Meeting", vol. II, "Heat Transfer in a Two–Pass Internally Ribbed Turbine Blade Coolant channel with Cylindrical Vortex Generators", Hibbs et al. pp. 371–390, Oct. 1995.

"Proceedings of the Advanced Turbine Systems Annual Program Review Meeting", vol. II, "Rotational Effects on Turbine Blade Cooling", Govatzidakia et al., pp. 391–392, Oct. 1995.

"Proceedings of the Advanced Turbine Systems Annual Program Review Meeting", vol. II, "Manifold Methods for Methane Combustion", Yang et al., pp. 393–409, Oct. 1995.

"Proceedings of the Advanced Turbine Systems Annual Program Review Meeting", vol. II, "Advanced Multistage Turbine Blade Aerodynamics, Performance, Cooling, and Heat transfer", Fleeter et al., pp. 410–414, Oct. 1995.

"Proceedings of the Advanced Turbine Systems Annual Program Review Meeting", vol. II, The Role of Reactant Unmixedness, Strain Rate, and Length Scale on Premixed Combustor Performance, Samuelsen et al., pp. 415–422, Oct. 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Stema Cooling", Desai et al., pp. 452–464, Oct. 1995.

"Proceedings of the Advanced Turbine Systems Annual Program Review Meeting", vol. II, "Use of a Laser–Induced Fluorescence Thermal Imaging System for film Cooling Heat Transfer Measurement", M. K. Chyu., pp. 465–473, Oct. 1995.

"Proceedings of the Advanced Turbine Systems Annual Program Review Meeting", vol. II, Effects of Geometry on Slot–Jet Film Cooling Performance, Hyams et al., pp. 474–496 Oct. 1995.

"Proceedings of the Advanced Turbine Systems Annual Program Review Meeting", vol. II, "Steam as Turbine Blade Coolant: Experimental Data Generation", Wilmsen et al., pp. 497–505, Oct. 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct. 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct. 1995.

"Proceedings of the Advanced Turbine Systems Annual Program Review Meeting", vol. II, "Combustion Chemical Vapor Deposited coating for Thermal Barrier Coating Systems", Hampikian et al., pp. 506–515, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct. 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct. 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct. 1995.

"Proceedings of the Advanced Turbine Systems Annual Program Review Meeting", vol. II, "Heat Pipe Turbine Vane Cooling", Langston et al., pp. 566–572, Oct. 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct. 1995.

"Proceedings of the Advanced Turbine Systems Annual Program Review Meeting", vol. II, "Advanced 3D Inverse Method for Designing Turbomachine Blades", T. Dang, pp. 582, Oct. 1995.

"Proceedings of the Advanced Turbine Systems Annual Program Review Meeting", "ATS and the Industries of the Future", Denise Swink, page 1, Nov. 1996.

"Proceedings of the Advanced Turbine Systems Annual Program Review Meeting", "Gas Turbine Association Agenda", William H. Day. pp. 3–16, Nov. 1996.

"Proceedings of the Advanced Turbine Systems Annual Program Review Meeting", "Power Needs in the Chemical Industry", Keith Davidson, pp. 17–26, Nov. 1996.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", "Advanced Turbine Systems Program Overview", David Esbeck, pp. 27–34, Nov. 1996.

"Proceedings of the Advanced Turbine Systems Annual Program Review Meeting", "Westinghouse's Advanced Turbine Systems Program", Gerard McQuiggan, pp. 35–48, Nov. 1996.

"Proceedings of the Advanced Turbine Systems Annual Program Review Meeting", "Overview of GE's H Gas Turbine Combined Cycle", Cook et al., pp. 49–72, Nov. 1996.

"Proceedings of the Advanced Turbine Systems Annual Program Review Meeting", "Allison Advanced Simple Cycle Gas Turbine System", William D. Weisbrod, pp. 73–94, Nov. 1996.

"Proceedings of the Advanced Turbine Systems Annual Program Review Meeting", "The AGTSR Industry–University Consortium", Lawrence P. Golan, pp. 95–110, Nov. 1996.

"Proceedings of the Advanced Turbine Systems Annual Program Review Meeting", "$NO_x$ and CO Emissions Models for Gas–Fired Lean–Premixed Combustion Turbines", A. Mellor, pp. 111–122, Nov., 1996.

"Proceedings of the Advanced Turbine Systems Annual Program Review Meeting", "Methodologies for Active Mixing and Combustion Control", Uri Vandsburger, pp. 123–156, Nov. 1996.

"Proceedings of the Advanced Turbine Systems Annual Program Review Meeting", "Combustion Modeling in Advanced Gas Turbine Systems", Paul O. Hedman, pp. 157–180, Nov. 1996.

"Proceedings of the Advanced Turbine Systems Annual Program Review Meeting", "Manifold Methods for Methane Combustion", Stephen B. Pope, pp. 181–188, Nov. 1996.

"Proceedings of the Advanced Turbine Systems Annual Program Review Meeting", "the Role of Reactant Unmixedness, Strain Rate, and Length Scale on Premixed Combustor Performance", Scott Samuelsen pp. 189–210, Nov. 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov. , 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", "Active Control of Combustion Instabilities in Low $NO_x$ Turbines", Ben T. Zinn, pp. 253–264, Nov., 1996.

"Proceedings of the Advanced Turbine Systems Annual Program Review Meeting", "Life Prediction of Advanced Materials for Gas Turbine Application,", Sam Y. Zamrik, pp. 265–274, Nov. 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov. 1996.

"Proceedings of the Advanced Turbine Systems Annual Program Review Meeting", "Compatibility of Gas Turbine Materials with Steam Cooling", Vimal Desai, pp. 291–314, Nov. 1996.

"Proceedings of the Advanced Turbine Systems Annual Program Review Meeting", "bond Strength and Stress Measurements in Thermal Barrier Coatings", Maurice Gell, pp. 315–334, Nov. 1996.

"Proceedings of the Advanced Turbine Systems Annual Program Review Meeting", "Advanced Multistage Turbine Blade Aerodynamics, performance, Cooling and Heat Transfer", Sanford Fleeter, pp. 335–356, Nov. 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov. 1996.

"Proceedings of the Advanced Turbine Systems Annual Program Review Meeting", "Improved Modeling Techniques for Turbomachinery Flow Fields", B. Lakshiminarayana, pp. 371–392, Nov. 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thone Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov. 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460. Nov., 1996.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.
"Proceedings of the Advanced Turbine Systems Annual Program Review Meeting", "Steam as a Turbine Blade Coolant: External Side Heat Transfer", Abraham Engeda, pp. 471–482, Nov. 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov. 1996.
"Proceedings of the Advanced Turbine Systems Annual Program Review Meeting", "Closed–Loop Mist/Steam Cooling for Advanced Turbine Systems", Ting Wang, pp. 499–512, Nov. 1996.
"Proceedings of the Advanced Turbine Systems Annual Program Review Meeting", "Heat Pipe Turbine Vane Cooling", Langston et al., pp. 513–534, Nov. 1996.
"Proceedings of the Advanced Turbine Systems Annual Program Review Meeting", "EPRI's Combustion Turbine Program: Status and Future Directions", Arthur Cohn, pp. 535–552 Nov. 1996.
"Proceedings of the Advanced Turbine Systems Annual Program Review Meeting", "ATS Materials Support", Michael Karnitz, pp. 553–576, Nov. 1996.
"Proceedings of the Advanced Turbine Systems Annual Program Review Meeting", "Land Based Turbine Casting Initiative", Boyd A. Mueller, pp. 577–592, Nov. 1996.
"Proceedings of the Advanced Turbine Systems Annual Program Review Meeting", "Turbine Airfoil Manufacturing Technology", Charles S. Kortovich, pp. 593–622, Nov. 1996.
"Proceedings of the Advanced Turbine Systems Annual Program Review Meeting", "Hot Corrosion Testing of TBS's", Norman Bornstein, pp. 623–631, Nov. 1996.
"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov. 1996.
"Proceedings of the Advanced Turbine Systems Annual Program Review Meeting", "Status of Ceramic Gas Turbines in Russia", Mark van Roode, p. 671, Nov. 1996.
"Status Report: The U.S. Department of Energy's Advanced Turbine Systems Program", facsimile dated Nov. 7, 1996.
"Testing Program Results Validate GE's Gas Turbine –High Efficiency, Low Cost of Electricity and Low Emissions", Roger Schonewald and Patrick Marolda, (no date available).
"Testing Program Results Validate GE's H Gas Turbine –High Efficiency, Low Cost of Electricity and Low Emissions", Slide Presentation –working draft, (no date available).
"The Next Step in H. . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996. Publication Date, Jun. 1, 1997, Report Numbers: DOE/MC/31176—5628.
"Utility Advanced Turbine System (ATS) Technology Readiness Testing—Phase 3", Document #666274, Oct. 1, 1996–Sep. 30, 1997, Publication Date, Dec. 31, 1997, Report Numbers: DOE/MC/31176—10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Numbers: DOE/MC/31176—5340.
"Utility Advanced Turbine System (ATS) Technology Readiness Testing and Pre–Commercial Demonstration –Phase 3", Document #486132, Apr. 1 –Jun. 30, 1976, Publication Date, Dec. 31, 1996, Report Numbers: DOE/MC/31176—5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Numbers: DOE/MC/31176—5339.
"Utility Advanced Turbine System (ATS) Technology Readiness Testing and Pre–Commercial Demonstration" Document #666277, Apr. 1 –Jun. 30, 1997, Publication Date, Dec. 31, 1997, Report Numbers: DOE/MC/31176—8.
"Utility Advanced Turbine System (ATS) Technology Readiness Testing and Pre–Commercialization Demonstration"Jan. 1 –Mar. 31, 1996, DOE/MC/31176—5338.
"Utility Advanced Turbine System (ATS) Technology Readiness Testing: Phase 3R", Document #756552, Apr. 1 –Jun. 30, 1999, Publication Date, Sep. 1, 1999, Report Numbers: DE—FC21–95MC31176–23.
"Utility Advanced Turbine System (ATS) Technology Readiness Testing", Document #656823, Jan. 1 –Mar. 31, 1998, Publication Date, Aug. 1, 1998, Report Numbers: DOE/MC/31176–17.
"Utility Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine System (ATS) Technology Readiness Testing", Phase 3R, Annual Technical Progress Report, Reporting Period: Oct. 1, 1997 –Sep. 30, 1998.
"Utility Advanced Turbine Systems (ATS) Technology Readiness Testing", Document #750405, Oct. 1–Dec. 30, 1998, Publication Date: May, 1, 1999, Report Numbers: DE–FC21–95MC31176–20.
"Utility Advanced Turbine Systems (ATS) Technology Readiness Testing", Document #1348, Apr. 1 –Jun. 29, 1998, Publication Date Oct. 29, 1998, Report Numbers: DE–FC21–95MC31176—18.
"Utility Advanced Turbine System (ATS) Technology Readiness Testing –Phase 3", Annual Technical Progress Report, Reporting Period: Oct. 1, 1996 –Sep. 30, 1997.
"Utility Advanced Turbine System (ATS) Technology Readiness Testing and Pre–Commercial Demonstration", Quarterly Report, Jan. 1 –Mar. 31, 1997, Document #666275, Report Numbers: DOE/MC/31176–07.
"Proceedings of the 1997 Advanced Turbine Systems", Annual Program Review Meeting, Oct. 28–29, 1997.

* cited by examiner

COOLING CIRCUIT FOR A GAS TURBINE BUCKET AND TIP SHROUD

This is a continuation of application Ser. No. 09/285,499 filed Apr. 1, 1999, now abandoned, the entire content of which is hereby incorporated by reference in this application.

This invention was made with Government support under Contract No. DE-FC21-95MC31176 awarded by the Department of Energy. The Government has certain rights in this invention.

TECHNICAL FIELD

This invention relates to a cooling air circuit for a gas turbine bucket tip shroud.

BACKGROUND OF THE INVENTION

Gas turbine buckets have airfoil shaped body portions connected at radially inner ends to root portions and at radially outer ends to tip portions. Some buckets incorporate shrouds at the radially outermost tip, and which cooperate with like shrouds on adjacent buckets to prevent hot gas leakage past the tips and to reduce vibration. The tip shrouds are subject to creep damage, however, due to the combination of high temperature and centrifugally induced bending stresses. In U.S. Pat. No. 5,482,435, there is described a concept for cooling the shroud of a gas turbine bucket, but the cooling design relies on air dedicated to cooling the shroud. Other cooling arrangements for bucket airfoils or fixed nozzle vanes are disclosed in U.S. Pat. Nos. 5,480,281; 5,391,052 and 5,350,277.

BRIEF SUMMARY OF THE INVENTION

This invention utilizes spent cooling air exhausted from the airfoil itself for cooling the associated tip shroud of the bucket. Specifically, the invention seeks to reduce the likelihood of gas turbine tip shroud creep damage while minimizing the cooling flow required for the bucket airfoil and shroud. Thus, the invention proposes the use of air already used for cooling the bucket airfoil, but still at a lower temperature than the gas in the turbine flowpath, for cooing the tip shroud.

In one exemplary embodiment of the invention, leading and trailing groups of cooling holes extend radially outwardly within the airfoil generally along respective leading and trailing edges of the airfoil. Each group of holes communicates with a respective cavity or plenum in the radially outermost portion of the airfoil. Spent cooling air from the radial cooling passages flows into the pair of plenums and then through holes in the tip shroud and exhausted into the hot gas path. These latter holes can extend within the plane of the tip shroud and open along the peripheral edges of the shroud, or at an angle so as to open through the top surface of the shroud.

In a second exemplary embodiment, relatively small film cooling holes are drilled through the radial plenum walls on both the pressure and suction side of the airfoil. These holes open on the underside of the shroud, in the area of the shroud fillets. In a variation of this arrangement, the leading and trailing plenums as described above are connected by an internal connector cavity. Preferably, the majority of the cooling holes open along the pressure and suction side in the leading edge area of the blade, with fewer holes opening in the trailing edge area. Covers are joined to the shroud to close the plenums and one or more metering holes are drilled in the respective covers in order to control the cooling air exhaust.

In a third exemplary embodiment, the individual radial cooling holes within the airfoil are drilled slightly oversize at the tip shroud end. In other words, each cooling hole may be considered to have its own plenum or chamber. Plugs or inserts are joined to the holes to seal the ends of the latter, while shroud cooling holes are drilled directly into the individual plenums and exit either at the top of the shroud or along the underside of the shroud. A metering hole may be required in the various radial cooling hole plugs to insure proper flow distribution.

In its broader aspects, the invention relates to an open cooling circuit for a gas turbine bucket wherein the bucket has an airfoil portion, and a tip shroud, the cooling circuit comprising a plurality of radial cooling holes extending through the airfoil portion and communicating with an enlarged internal area within the tip shroud before exiting the tip shroud such that a cooling medium used to cool the airfoil portion is subsequently used to cool the tip shroud.

In another aspect, the invention relates to an open cooling circuit for a gas turbine airfoil and associated tip shroud comprising a plurality of cooling holes internal to the airfoil and extending in a radially outward direction; a first plenum chamber in an outer radial portion of the airfoil, each of the plurality of holes communicating with the plenum; additional cooling holes in the tip shroud, communicating with the plenum, and exiting through the tip shroud.

In still another aspect, the invention relates to a method of cooling a gas turbine airfoil and associated tip shroud comprising a) providing radial holes in the airfoil and supplying cooling air to the radial holes; b) channeling the cooling air to a plenum in the airfoil; and c) passing the cooling air from the plenum and through the tip shroud.

Additional objects and advantages of the invention will become apparent from the detailed description which follows.

DETAILED DESCRIPTION OF THE INVENTION

Figure 1:
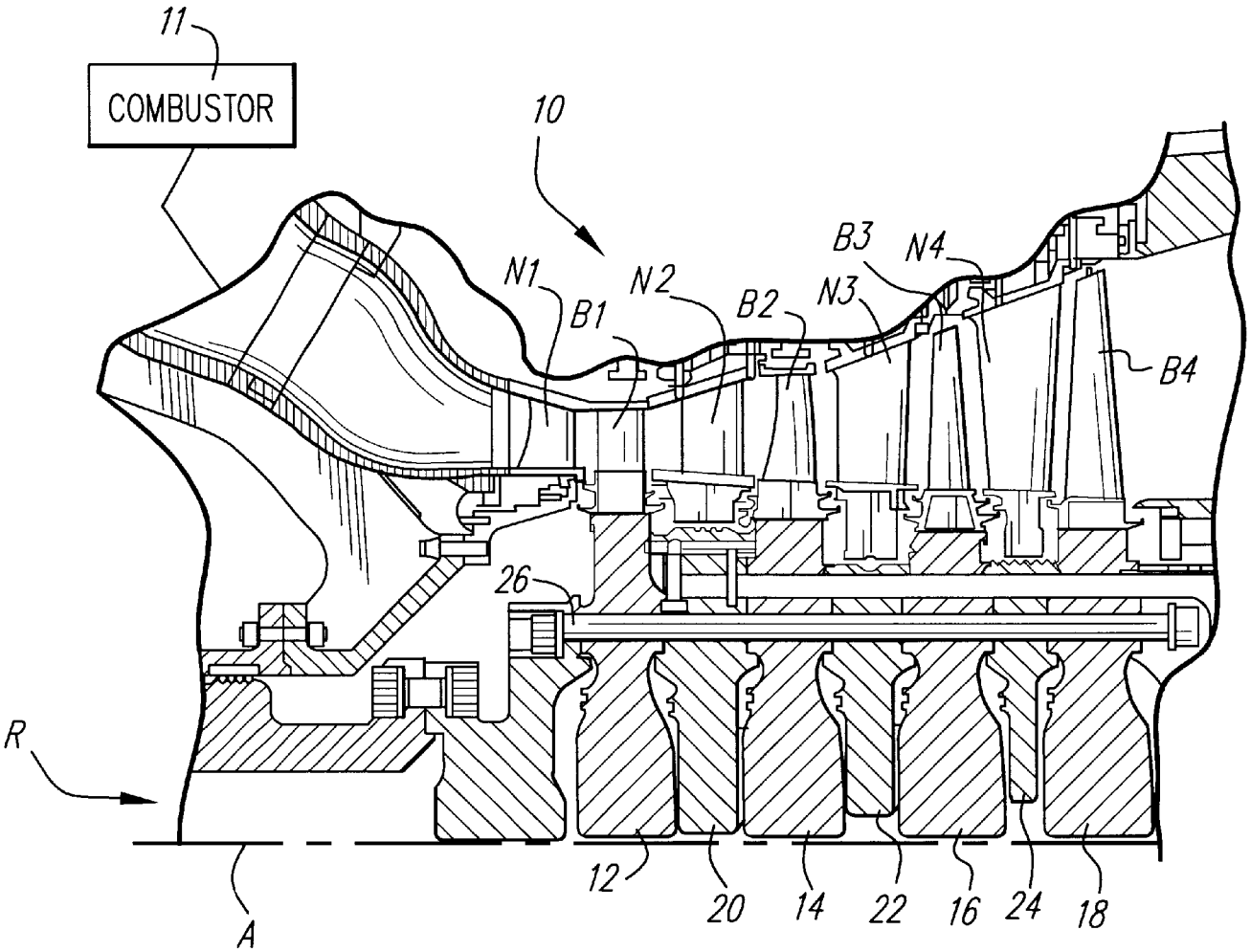
FIG. 1 is a partial side section illustrating the turbine section of a land based gas turbine.

With reference to FIG. 1, the turbine section 10 of a gas turbine is partially illustrated. The turbine section 10 of the gas turbine is downstream of the turbine combustor 11 and includes a rotor, generally designated R, with four successive stages comprising turbine wheels 12, 14, 16 and 18 mounted to and forming part of the rotor shaft assembly for rotation therewith. Each wheel carries a row of buckets B1, B2, B3 and B4, the blades of which project radially outwardly into the hot combustion gas path of the turbine. The buckets are arranged alternately between fixed nozzles N1, N2, N3 and N4. Alternatively, between the turbine wheels from forward to aft are spacers 20, 22 and 24, each located radially inwardly of a respective nozzle. It will be appreciated that the wheels and spacers are secured to one another by a plurality of circumferentially spaced axially extending bolts 26 (one shown), as in conventional gas turbine construction.

Figure 2:
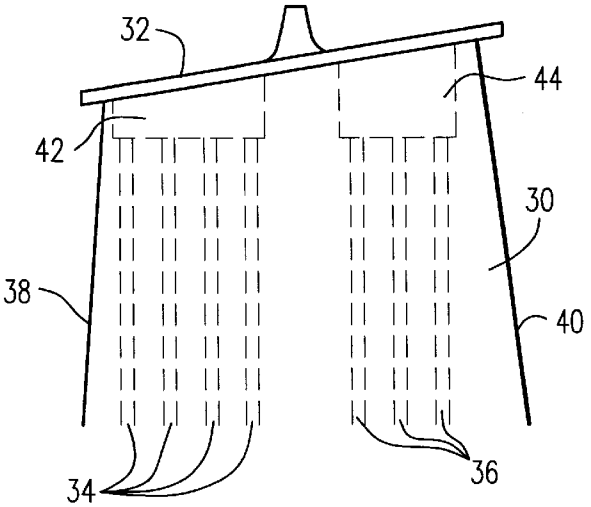
FIG. 2 is a partial side elevation, in generally schematic form, illustrating groups of radial cooling passages in a turbine blade and tip shroud in accordance with a first exemplary embodiment of the invention.
Figure 3:
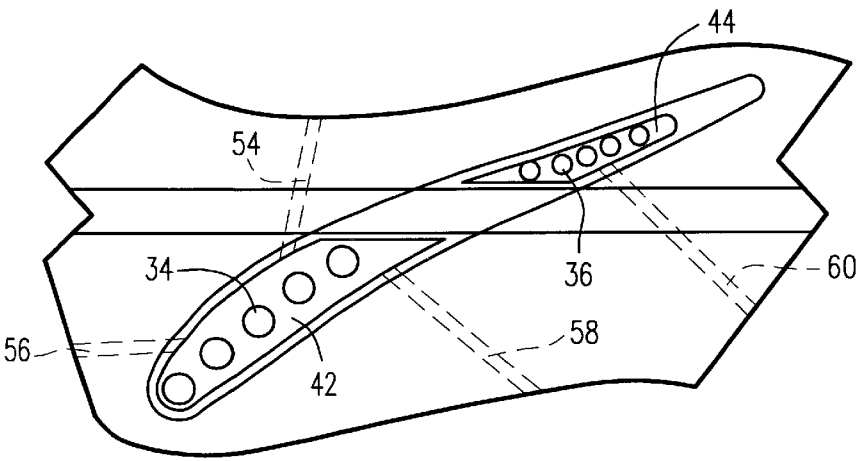
FIG. 3 is a top plan view of a tip shroud in accordance with the first embodiment of the invention.

Turning now to FIGS. 2 and 3, a turbine bucket includes a blade or airfoil portion 30 and an associated radially outer tip shroud 32. The airfoil 30 has a first set of internal radially extending cooling holes generally designated 34, and a second set of five radially extending cooling holes 36. The first set of cooling holes 34 is located in the forward half of the airfoil, closer to the leading edge 38, whereas the second set of holes 36 is located toward the rearward or trailing edge 40 of the airfoil. The first set of leading edge cooling holes 34 open to a first cavity or plenum 42 at the radially outermost portion of the airfoil, while trailing edge cooling holes 36 open into a second plenum 44 closer to the trailing edge 40 of the airfoil. The plenums 42 and 44 are shaped to conform generally with the shape of the airfoil, and extend radially into the tip shroud 32. The plenums are sealed by recessed covers such as those shown at 46, 48, respectively, in FIG. 4. The covers may have metering holes 50, 52 for controlling the exhaust rate of the cooling air into the hot gas path.

In addition, the plenums 42 and 44 can exhaust directly through cooling passages internal to the tip shroud. For example, as shown in FIG. 3, spent cooling air from chamber 42 can exhaust through the edges of the tip shroud via passages 54, 56 and 58 which lie in the plane of the shroud 32 and which distribute cooling air within the shroud itself, thus film cooling and convection cooling the shroud. Similarly, plenum 44 communicates with a similar passage 60 in the trailing edge portion of the shroud 32.

It will be appreciated that the number and diameter of radial holes in the airfoil will depend on the design requirements and manufacturing process capability. Thus, FIG. 2 shows groups 34, 36 of four and three radial holes respectively, whereas FIG. 3 shows both groups to have five radial holes each.

Figure 4:
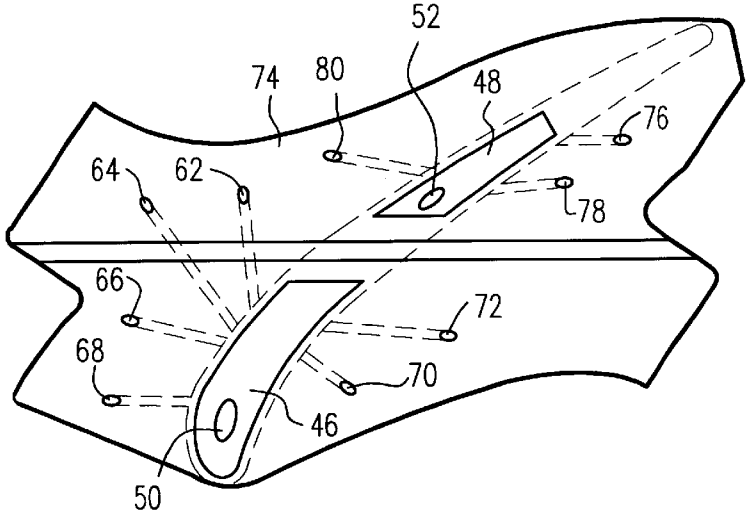
FIG. 4 is a top plan view showing an alternative to the arrangement shown in FIG. 3.

In FIG. 4, a variation of this embodiment has cooling holes 62, 64, 66, 68, 70 and 72 in the tip shroud, in communication with the leading plenum 42, but angled relative to the plane of the tip shroud so that they exhaust through the top surface 74 of the tip shroud, rather than at the shroud edge. Similarly, cooling holes 76, 78 and 80 in communication with the trailing plenum 44 also exhaust through the top surface 74 of the shroud.

Figure 5:
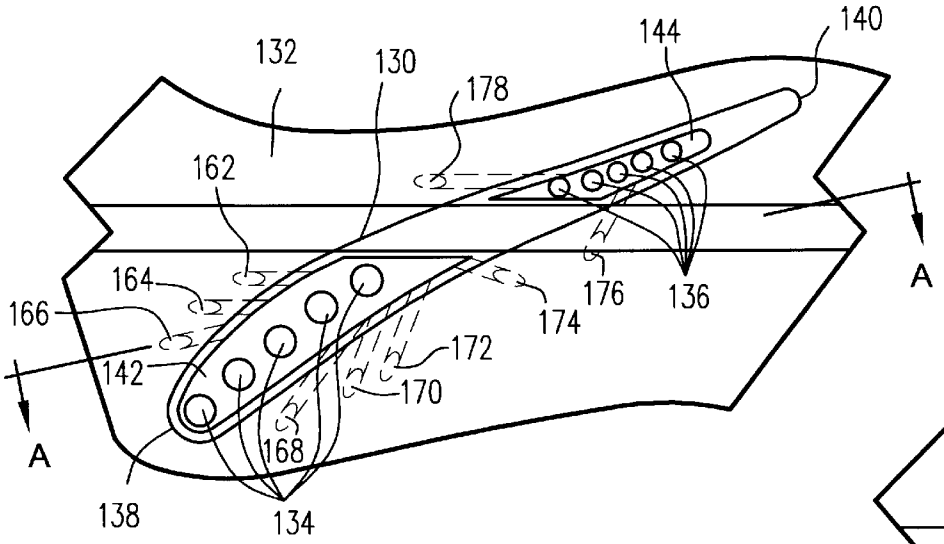
FIG. 5 is a top plan view of a turbine airfoil and tip shroud in accordance with a second exemplary embodiment of the invention.
Figure 7:
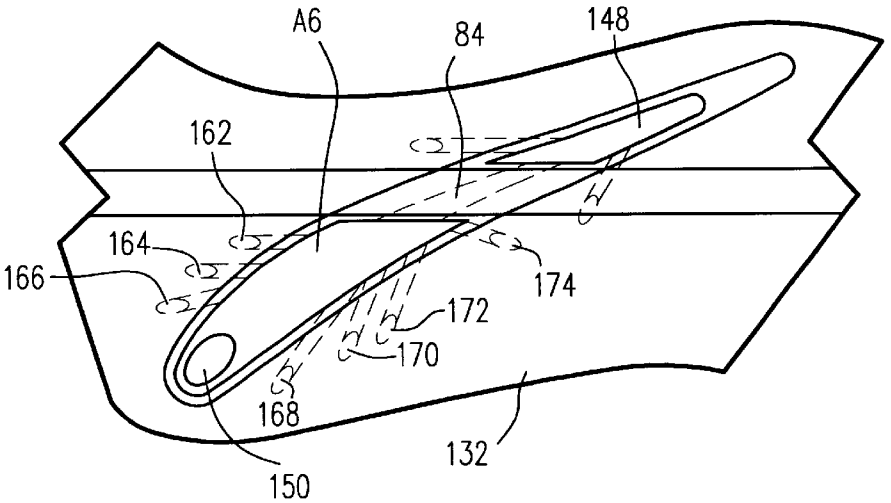
FIG. 7 is a top plan of an airfoil and tip shroud similar to FIG. 5, but illustrating a connector cavity between the interior plenums.
Figure 6:
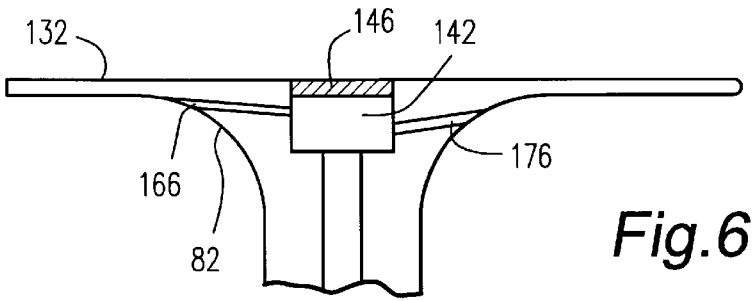
FIG. 6 is a section taken along the line A—A of FIG. 5.

FIGS. 5 and 6 illustrate a second embodiment of the invention, and, for convenience, reference numerals similar to those used in FIGS. 2 and 3 are used in FIG. 4 where applicable to designate corresponding components, but with the prefix "1" added. Thus, a first set of radially extending internal cooling holes 134 extends radially outwardly through the airfoil, closer to the leading edge 138 of the airfoil, opening at plenum 142. A similar second set of cooling holes 136 extends radially outwardly within the airfoil, closer to the trailing edge 140 of the airfoil, opening into plenum 144. A first group of shroud cooling holes 162, 164, 166 and 168, 170, 172 and 174 extend from both the pressure and suction sides, respectively, of the plenum 142 to provide film and convection cooling of the underside of the tip shroud 132, with the cooling holes exiting the airfoil in the area of the tip shroud fillet 82. A second group of shroud cooling holes 176, 178 extend from plenum 144 and open on pressure and suction sides, respectively of the airfoil, again on the underside of the tip shroud. As in the previous embodiment, flow may also be metered out of the plenum covers 146, 148 by means of one or more metering holes 150 (FIG. 7). The number of shroud cooling holes exiting on the pressure and suction sides of the shroud may vary as required.

FIG. 7 is similar to FIG. 5 but includes a connector cavity 84 extending internally between the leading and trailing plenums 142, 144, respectively. Cooling holes from the plenums exhaust about the tip shroud undersurface as described above. The connector cavity 84 results in most cooling air flowing to the leading edge plenum 142 to exit via cooling holes 162, 164, 166 and 168, 170, 172 and 174 arranged primarily along the pressure and suction sides, respectively, of the airfoil in the leading edge region thereof. As in FIG. 6, only two of the cooling holes 176, 178 exit in the trailing edge area of the airfoil. This arrangement desirably channels most of the cooling air to the leading edge region of the airfoil, to be washed back across the trailing edge region by the hot combustion gas, thereby providing desirable cooling of the shroud. The metering hole 150 in the cover 146 exhausts all of the spent cooling air which is not otherwise used for direct tip shroud cooling along the undersurface thereof, and dilutes the hot gas flowing over the top of the shroud.

FIGS. 8–11 illustrate a third embodiment of the invention, and, for convenience, reference numerals similar to those used to describe the earlier embodiments are used in FIGS. 8–11 where applicable to designate corresponding components, but with the prefix "2" added. A first set of radially extending internal cooling holes 234 extends radially outwardly through the airfoil, closer to the leading edge 238 of the airfoil. A second set of internal cooling holes extends radially outwardly within the airfoil, closer to the trailing edge 240 of the airfoil. Each individual radial cooling hole 234 is drilled or counterbored at its radially outer end to define an individual plenum 242, while each radial cooling hole 236 is similarly drilled or counterbored to form a similar but smaller plenum 244. Each enlarged chamber or plenum 242, 244 is sealed by a plug or cover 246 (in FIGS. 8 and 9, the plugs or covers 246 are omitted for purposes of clarity). Each plug or cover may be provided with a metering hole 250 to insure proper flow distribution.

A first group of shroud film cooling holes 262, 264, 266, 268, 270, and 272 extend from the various plenums 242 through the tip shroud and open along the top surface of the tip shroud. Similarly, a second group of film cooling holes 274, 276, and 278 extend from the plenums 244 and also open along the top surface of the tip shroud. Note that film cooling holes 264 and 262 extend from the same plenum, while film cooling holes 270 and 272 extend from the next adjacent plenum. The arrangement may vary, however, depending on particular applications.

Figure 9:
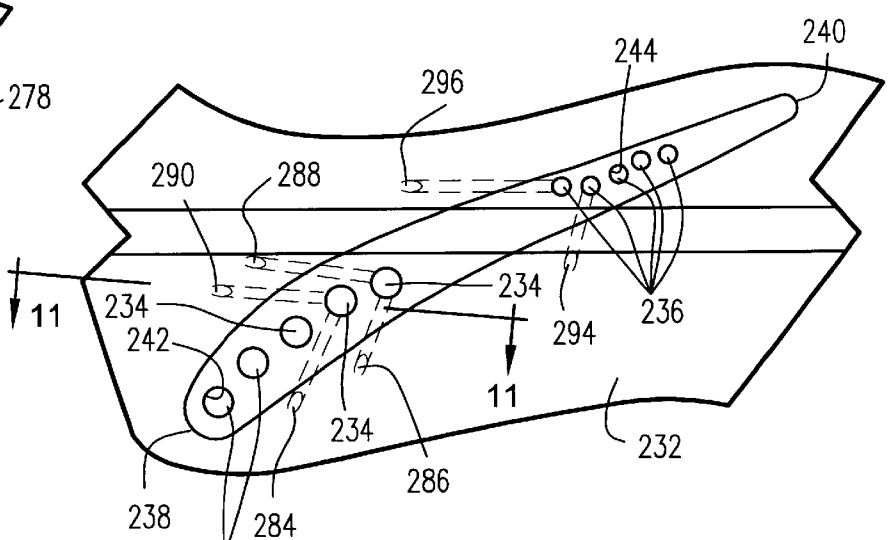
FIG. 9 is a top plan view of the tip shroud shown in FIG. 8, but illustrating the shroud cooling holes which open along the bottom surface of the tip shroud.
Figure 11:
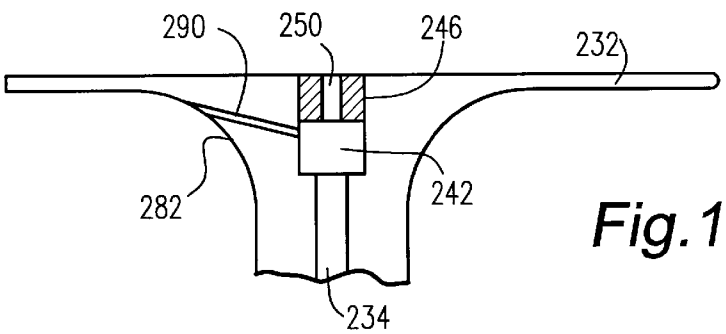
FIG. 11 is a section taken along the line 11—11 of FIG. 9.
Figure 8:
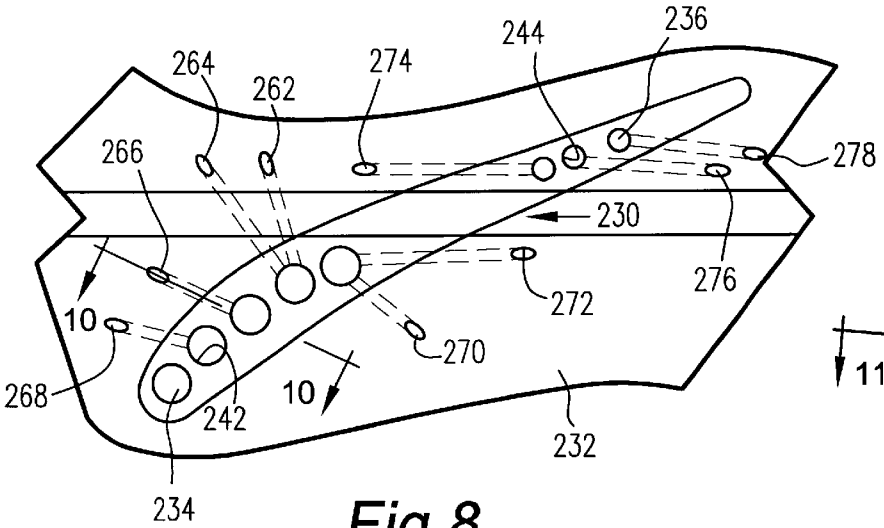
FIG. 8 is a top plan view of a tip shroud in accordance with a third exemplary embodiment of the invention, illustrating shroud cooling holes opening on the top surface of the tip shroud.
Figure 10:
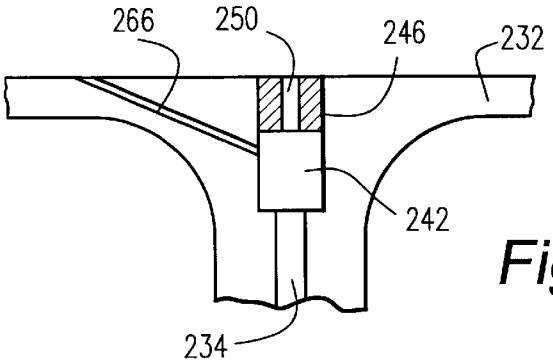
FIG. 10 is a section taken along the line 10—10 of FIG. 8.

FIG. 9 illustrates film cooling holes extending from the plenums 242 and 244, but which open along the underside of the tip shroud, generally along the tip shroud fillet 282. Thus, film cooling holes 284, 286, 288, and 290 extend from two of the plenums 242 and open on the underside of the tip shroud, on both pressure and suction sides of the airfoil. Note that film cooling holes 284 and 290 extend from the same plenum, while a similar arrangement exists with respect to shroud film cooling holes 286 and 288 which extend from the adjacent plenum.

Shroud film cooling holes 294 and 296 extend from a pair of adjacent plenums 244 associated with radial cooling holes 236 on the opposite side of the tip shroud seal, also along the underside of the tip shroud.

These arrangements are intended to reduce the likelihood of gas turbine shroud creep damage while minimizing the cooling flow required for the bucket, while more efficiently utilizing spent airfoil cooling air to also cool the tip shroud.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An open cooling circuit for a gas turbine airfoil and associated tip shroud comprising:

first and second sets of cooling holes internal to the airfoil and extending in a radially outward direction and arranged respectively in proximity to leading and trailing edges of said airfoil;

a pair of enlarged plenums in an outer radial portion of the airfoil, communicating respectively with said first and second sets of radial cooling holes; and at least one film cooling hole in the tip shroud, communicating with one of said pair of plenums, and exiting through the tip shroud.

2. The cooling circuit of claim 1 wherein the cooling medium is exhausted from said tip shroud into a gas turbine hot combustion gas path.

3. The cooling circuit of claim 1 wherein said at least one film cooling hole exits through a peripheral edge of said tip shroud.

4. The cooling circuit of claim 1 wherein said at least one film cooling hole exits through a top surface of said tip shroud.

5. The cooling circuit of claim 1 and further comprising at least one film cooling hole extending from one of said plenums in said airfoil, exiting at the underside of said tip shroud.

6. The cooling circuit of claim 5 wherein a plurality of film cooling holes exit in a leading edge region of the airfoil, along the underside of said tip shroud.

7. An open cooling circuit for a gas turbine bucket wherein the bucket has an airfoil portion, and a tip shroud, the cooling circuit each comprising a plurality of radial cooling holes extending through said airfoil portion and communicating with respective film cooling holes that open along said tip shroud such that a cooling medium used to cool the airfoil portion is subsequently used to cool the tip shroud wherein a discrete enlarged plenum is provided in the airfoil for each radial cooling hole between each radial cooling hole and one or more of said film cooling holes.

8. A method of cooling a gas turbine airfoil and associated tip shroud comprising:

a) providing first and second sets of radial cooling holes in said airfoil arranged respectively in proximity to leading and trailing edges of said airfoil, and supplying cooling air to said first and second sets of cooling holes;

b) channeling said cooling air from said first and second sets of cooling holes into a pair of enlarged plenums in said airfoil; and c) passing said cooling air from said pair of enlarged plenums through said tip shroud.

9. The method of claim 8 including channeling most of the cooling air into one of said pair of plenums located in proximity to said leading edge of the airfoil and exhausting the cooling air through holes opening along an underside of said tip shroud.

10. The method of claim 9 including the step of exhausting some portion of the cooling air through the top of the tip shroud.

11. The method of claim 8 wherein step c) is carried out by providing cooling exhaust holes in said tip shroud, opening along a peripheral edge of the tip shroud.

12. The method of claim 8 wherein step c) is carried out by exiting a portion of said cooling air along an underside of the tip shroud and another portion of the cooling air along a top surface of the tip shroud.

13. A gas turbine bucket comprising an airfoil portion and a tip shroud at a radially outer end thereof;

first and second sets of cooling holes internal to the airfoil portion and extending in a radially outward direction and arranged respectively in proximity to leading and trailing edges of said airfoil portion;

a pair of enlarged plenums in an outer radial portion of the airfoil portion, communicating respectively with said first and second sets of radial cooling holes; and at least one film cooling hole in the tip shroud, communicating with one of said pair of plenums, and exiting through the tip shroud.

14. The gas turbine bucket of claim 13 wherein the cooling medium is exhausted from said tip shroud into a gas turbine hot combustion gas path.

15. The gas turbine bucket of claim 13 wherein said at least one film cooling hole exits through a peripheral edge of said tip shroud.

16. The gas turbine bucket of claim 13 wherein said at least one film cooling hole exits through a top surface of said tip shroud.

17. The gas turbine bucket of claim 13 and further comprising at least one film cooling hole extending from one of said plenums in said airfoil, exiting at the underside of said tip shroud.

18. The gas turbine bucket of claim 17 wherein a plurality of film cooling holes exit in a leading, edge region of the airfoil, along the underside of said tip shroud.

* * * * *